US007806063B2

(12) United States Patent
Shimizu

(10) Patent No.: US 7,806,063 B2
(45) Date of Patent: Oct. 5, 2010

(54) ELECTRONIC SEWING MACHINE AND SEWING MACHINE MOTOR CONTROL PROGRAM

(75) Inventor: Masaki Shimizu, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 635 days.

(21) Appl. No.: 11/802,855

(22) Filed: May 25, 2007

(65) Prior Publication Data

US 2007/0272136 A1 Nov. 29, 2007

(30) Foreign Application Priority Data

May 29, 2006 (JP) ..... 2006-147922

(51) Int. Cl.
*D05B 51/00* (2006.01)

(52) U.S. Cl. ..... 112/278; 112/273; 112/470.04

(58) Field of Classification Search ..... 112/273, 112/278, 470.01, 470.03, 470.04
See application file for complete search history.

(56) References Cited

U.S. PATENT DOCUMENTS

| | | | | |
|---|---|---|---|---|
| 4,766,827 | A * | 8/1988 | Matsubara | 112/278 |
| 5,161,475 | A * | 11/1992 | Tawara et al. | 112/278 |
| 5,199,365 | A * | 4/1993 | Arnold | 112/273 |
| 5,383,417 | A * | 1/1995 | Norrid | 112/278 |
| 6,012,405 | A * | 1/2000 | Melton et al. | 112/278 |
| 6,092,478 | A * | 7/2000 | Simakrai et al. | 112/278 |
| 6,802,273 | B2 | 10/2004 | Mizuno | |
| 6,863,007 | B2 * | 3/2005 | Fluckiger | 112/278 |
| 6,883,446 | B2 | 4/2005 | Koerner | |
| 7,308,333 | B2 * | 12/2007 | Kern et al. | 112/273 |
| 2003/0029365 | A1 * | 2/2003 | Butzen et al. | 112/273 |
| 2005/0223958 | A1 * | 10/2005 | Friman et al. | 112/470.01 |
| 2006/0213413 | A1 * | 9/2006 | Koerner | 112/278 |
| 2007/0256619 | A1 | 11/2007 | Koemer | |

FOREIGN PATENT DOCUMENTS

| | | |
|---|---|---|
| JP | B2-60-045552 | 10/1985 |
| JP | B2-60-045553 | 10/1985 |
| JP | A-07-039667 | 2/1995 |
| JP | A-2002-292175 | 10/2002 |
| JP | A-2002-369990 | 12/2002 |
| JP | A-2004-201946 | 7/2004 |
| JP | B2-3566742 | 9/2004 |

* cited by examiner

*Primary Examiner*—Gary L Welch
*Assistant Examiner*—Nathan E Durham
(74) *Attorney, Agent, or Firm*—Oliff & Berridge, PLC

(57) ABSTRACT

An electronic sewing machine includes a sewing machine motor that vertically drives a sewing needle via a rotation of a main shaft; a stitch-pitch setting unit that sets a stitch-pitch in sewing manually fed workpiece cloth; a consumed thread amount detection unit that detects consumed thread amount of at least either of a needle thread or a bobbin thread consumed in each ongoing sewing cycle; a consumed thread amount calculation unit that calculates consumed thread amount based on an output from the consumed thread amount detection unit; and a speed control unit that controls rotational speed of the sewing machine motor based on calculated result of the consumed thread amount calculation unit so that an amount of manual cloth feed equals the stitch-pitch set by the stitch-pitch setting unit.

14 Claims, 15 Drawing Sheets

ELECTRONIC SEWING MACHINE AND SEWING MACHINE MOTOR CONTROL PROGRAM

This application is based upon and claims the benefit of priority from the prior Japanese Patent Application 2006-147922, filed on, May 29, 2006 the entire contents of which are incorporated herein by reference.

FIELD

The present disclosure is directed to an electronic sewing machine and a sewing machine motor control program that allow the user to manually feed a cloth in consistent pitch when quilting a quilt.

BACKGROUND

There has been a demand to enable quilting with a sewing machine, in which stitches are formed while forming decorative patterns on the front side of a three-layered fabric having cotton, feather or urethane foam, or the like, stuffed between a front cloth and a back cloth. In such case, the user may enjoy quilting by combining straight stitches and curved stitches by vertically driving a needle bar and freely moving the three-layered quilting fabric in given directions.

For example, JP 2002-292175 A (pages 3 to 4, FIGS. 3 to 5) describes a sewing machine provided with a downwardly oriented image sensor mounted in a head of a sewing machine arm. The images captured by the image sensor are inputted to a microcomputer during the sewing operation and the sewing machine takes in a part of such images at predetermined small time intervals as static images. Then, a movement distance of the workpiece cloth is calculated by a first interrupt process. Thereafter, a second interrupt process obtains needle-bar movement speed, in other words, rotational speed of a sewing machine motor based on a preset "pitch-width" and the calculated movement distance, and changes the rotational speed of the sewing machine motor to the obtained rotational speed so that stitches formed by manual cloth feed is arranged at an consistent "pitch-width".

The sewing machine described in the above mentioned JP 2002-292175 A obtains the movement distance of the workpiece cloth during a sewing operation by processing a plurality of static images outputted at small time intervals from the image sensor provided in the head of the arm. However, not only is the image information provided by the image sensor affected by the color and material of the workpiece cloth and the color and brightness of external light radiated during the sewing operation, but may also be deteriorated by the distance between the image sensor and the workpiece cloth. Thus, it is not possible to obtain the movement distance of the workpiece cloth with consistent accuracy, leading to increased difficulty in providing a consistent "pitch-width" of the stitches.

In the light of the above, the image sensor may be placed in close proximity of the workpiece cloth, in other words, near a needle drop position to improve the accuracy in detecting the movement distance of the workpiece cloth. However, placing the image sensor in close proximity of the workpiece cloth may become an impediment to the user during the sewing work, consequently leading to problems such as poor workability.

SUMMARY

An object of the present disclosure is to obtain consistent stitch-pitch when manually feeding a workpiece cloth by improving accuracy in detecting movement distance of the workpiece cloth without deteriorating the workability of sewing work.

An electronic sewing machine according to one aspect of the present disclosure includes a sewing machine motor that vertically drives a sewing needle via a rotation of a main shaft; a stitch-pitch setting unit that sets a stitch-pitch in sewing manually fed workpiece cloth; a consumed thread amount detection unit that detects consumed thread amount of at least either of a needle thread or a bobbin thread consumed in each ongoing sewing cycle; a consumed thread amount calculation unit that calculates consumed thread amount based on an output from the consumed thread amount detection unit; and a speed control unit that controls rotational speed of the sewing machine motor based on calculated result of the consumed thread amount calculation unit so that an amount of manual cloth feed equals the stitch-pitch set by the stitch-pitch setting unit; wherein the consumed thread amount detection unit determines the consumed thread amount in each of the sewing cycles after a rotational phase angle of the mains haft reaches a predetermined rotational phase angle at which rotational phase angle the sewing needle strikes the workpiece cloth.

According to the above described electronic sewing, the consumed thread amount of at least either of the needle thread or the bobbin thread consumed by cloth feed is detected by the consumed thread amount detection unit in each ongoing sewing cycle during the sewing process. Moreover, consumed thread amount is calculated by the consumed thread amount calculation unit based on the output from the consumed thread amount detection unit. Based on the consumed thread amount thus calculated, rotational speed of the sewing machine motor is controlled so that manual cloth feed amount equals the stitch-pitch set by the stitch-pitch setting unit.

As a result, in case the actual stitch-pitch is greater than the stitch-pitch set, rotational speed of the sewing machine motor is controlled to accelerate, whereas in case the actual stitch-pitch is less than the stitch-pitch set, rotational speed of the sewing machine motor is controlled to decelerate. Thus, the movement distance of the workpiece cloth manually fed by the user, in other words, the stitch-pitch may be made consistent without being affected by the color and material of the workpiece cloth and color and brightness of exterior light radiated during the sewing process, thereby allowing sewing of fine-looking quilts.

A computer readable medium storing a sewing machine motor control program executed by a computer of a control unit that controls an electronic sewing machine provided with a sewing machine motor that vertically drives a sewing needle via rotation of a main shaft according to one aspect of the present disclosure includes instructions for setting a stitch-pitch in sewing manually fed workpiece cloth; instructions for detecting consumed thread amount of at least either of a needle thread or a bobbin thread consumed in each ongoing sewing cycle; instructions for calculating consumed thread amount based on an output from the instructions for detecting consumed thread amount; and instructions for controlling rotational speed of the sewing machine motor based on calculated result of the instructions for calculating so that an amount of manual cloth feed equals the stitch-pitch set by the instructions for setting; wherein the instructions for detecting consumed thread amount determines the consumed thread amount in each of the sewing cycles after a rotational phase angle of the main shaft reaches a predetermined rotational phase angle at which rotational phase angle the sewing needle strikes the workpiece cloth.

The above described computer readable medium, when executed, provides the same effects as those provided by the electronic sewing machine.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

The sewing machine and the sewing machine motor control program of the present disclosure is designed to provide consistent stitch-pitch even in case cloth is fed manually by controlling the rotational speed of the sewing machine motor by comparing actual stitch-pitch (feed amount) with the preset standard stitch-pitch. That is, in case the actual stitch-pitch is less than the preset stitch-pitch, the rotational speed of the sewing machine motor is decelerated whereas in case the actual stitch-pitch is greater than the preset stitch-pitch, the rotational speed of the sewing machine motor is accelerated.

Figure 1:
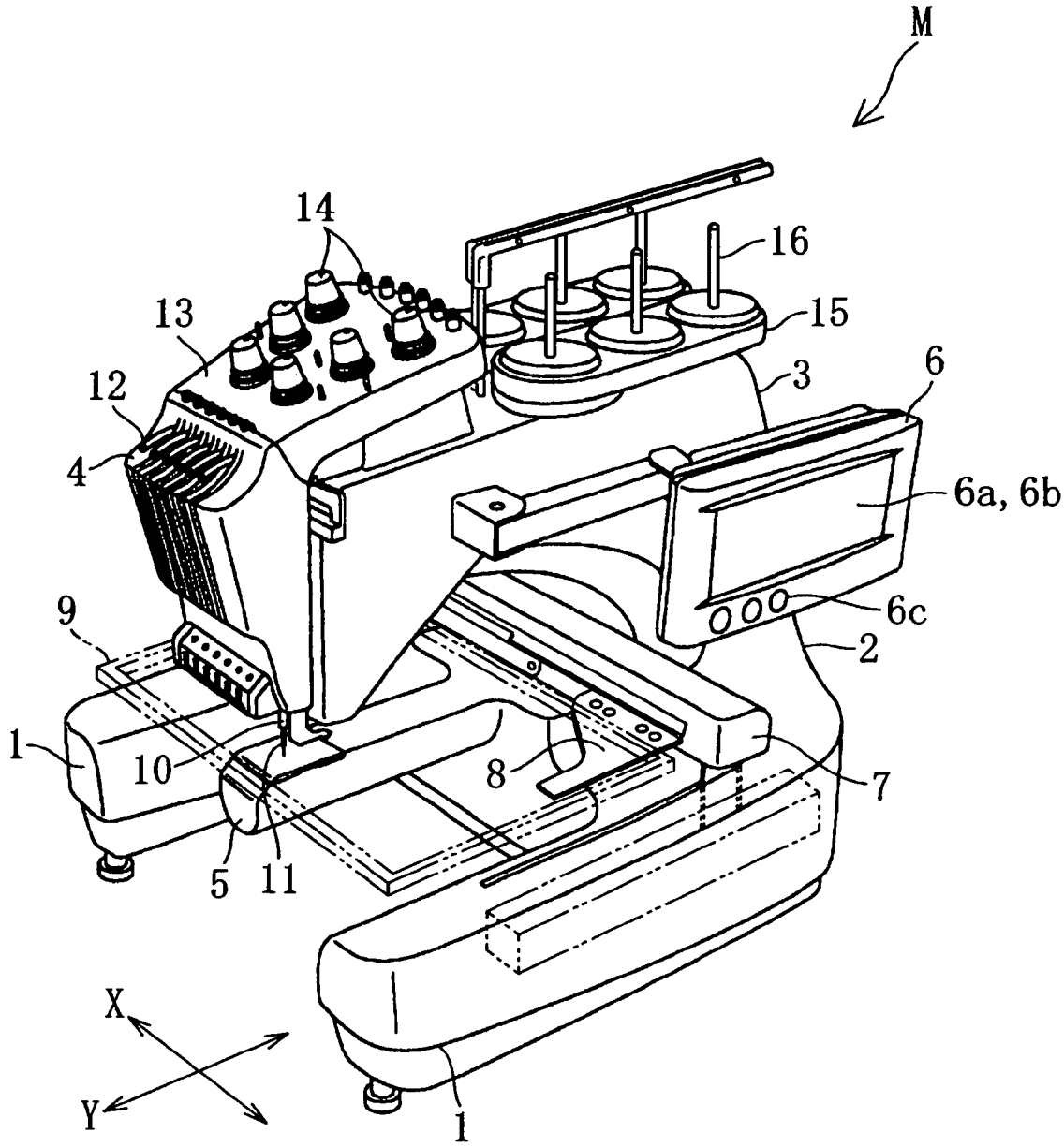
FIG. 1 is a perspective view of the multi-needle sewing machine.

Referring to FIG. 1, a multi-needle sewing machine M includes a left and right pair of legs 1 that supports the entire sewing machine; a pillar 2 standing at the rear end of the legs 1; an arm 3 extending forward from the upper portion of the pillar 2; a needle-bar case 4 attached to the front end of the arm 3; a cylinder bed 5 extending forward from the lower end of the pillar 2; and an operation panel 6.

A laterally oriented (X-shaft direction) carriage 7 is provided in the upper side of the legs 1. Provided inside the carriage 7 is a lateral drive mechanism (not shown) that laterally drives a frame stay plate 8 provided in the front side of the carriage 7 by an X-shaft drive motor 51 (refer to FIG. 4). Provided inside the legs 1 are a longitudinal drive mechanism (not shown) that longitudinally (Y-shaft direction) drives the carriage 7 by a Y-shaft drive motor 52 (refer to FIG. 4).

An embroidery frame 9 holds a workpiece cloth on which embroidery is formed. The embroidery frame 9 is mounted on the frame stay plate 8. The frame stay plate 8 is moved laterally by the lateral drive mechanism. The carriage 7 is moved longitudinally by the longitudinal drive mechanism. Thus, the embroidery frame 9 is moved longitudinally in synchronization with the carriage 7 and laterally with the frame stay plate 8, thereby feeding the workpiece cloth.

The needle bar case 4 is provided in the front end of the arm 3. The needle bar case 4 has six vertically movable needle bars 10 attached thereto. Sewing needles 11 are respectively attached to the lower end of each needle bar 10. The needle-bar case 4 has six vertically movable thread take-ups 12 respectively attached to each needle bar 10. A thread tension base 13 slightly tilted rearwardly upward and made of synthetic resin is secured to the upper end of the needle bar case 4. The thread tension base 13 has six thread tensioner 14 dedicated for the needle threads supplied to each sewing needle 11.

A spool pin stand 15 is provided in the upper side of the arm 3. The spool pin stand 15 has six spool pins 16 allowing attachment of six thread spools. Needle threads extending from each thread spool are threaded to the corresponding thread tensioners 14 and the thread take-ups 12, and the like, and thereafter supplied to the sewing needles 11 mounted on the lower ends of the needle bars 10.

Figure 4:
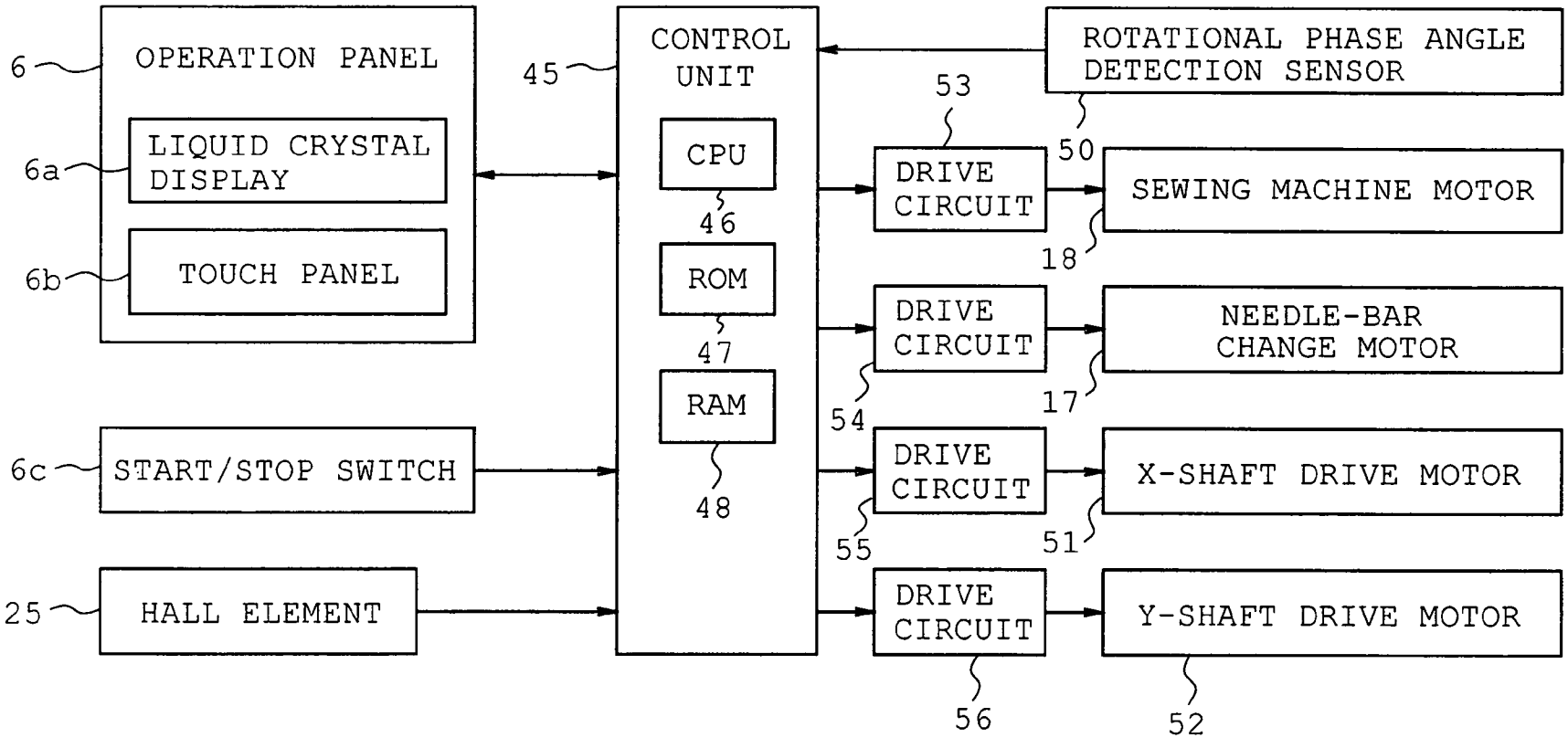
FIG. 4 is a block diagram of a control system of a multi-needle sewing machine.

Provided inside the arm 3 is a needle-bar selection mechanism (not shown) driven by a needle-bar change motor 17 (refer to FIG. 4). The needle-bar case 4 is laterally moved integrally with the thread tension base 13 by the needle-bar selection mechanism and one of the six needle bars 10 and thread take-ups 12 are selected and placed in a drive position.

When the sewing machine motor 18 (refer to FIG. 4) is driven, the needle bar 10 and the thread take-up 12 in the drive position are vertically driven in synchronism and form embroidery stitches on the workpiece cloth retained by the embroidery frame 9 situated above the cylinder bed 5 in cooperation with a rotary shuttle (not shown) provided in the front end of the cylinder bed 5. Further, a foldable operation panel 6 of a touch panel type is provided on the right side surface of the arm 3.

Referring to FIG. 1, the operation panel 6 is provided with a large, laterally elongate liquid crystal display 6*a*. The liquid crystal display 6*a* has a touch panel 6*b* provided on its surface. The touch panel 6*b* has a plurality of transparent touch keys that are associated with plurality types of pattern images and function names displayed on the liquid crystal display 6*a*. Further, a start/stop switch 6*c* for instructing start and stop of a sewing operation is provided below the liquid crystal display 6*a* along with other switches.

A work table (not shown) is attached in a horizontal disposition immediately above the left and right pair of legs 1 instead of the embroidery frame 9 when no embroidery sewing is being performed. The work table has a slit defined at its lateral mid-portion having a width equivalent to the width of the cylinder bed 5. The upper surface of the work table and the upper surface of the needle plate provided on the front end of the cylinder bed 5 are at level. Thus, the user is allowed to execute quilting by placing the quilting fabric on the work table.

Next, a description will be given on the thread tensioner 14. A description will be given on one of the six thread tensioner 14 since all six of them have the same structure.

Figure 2:
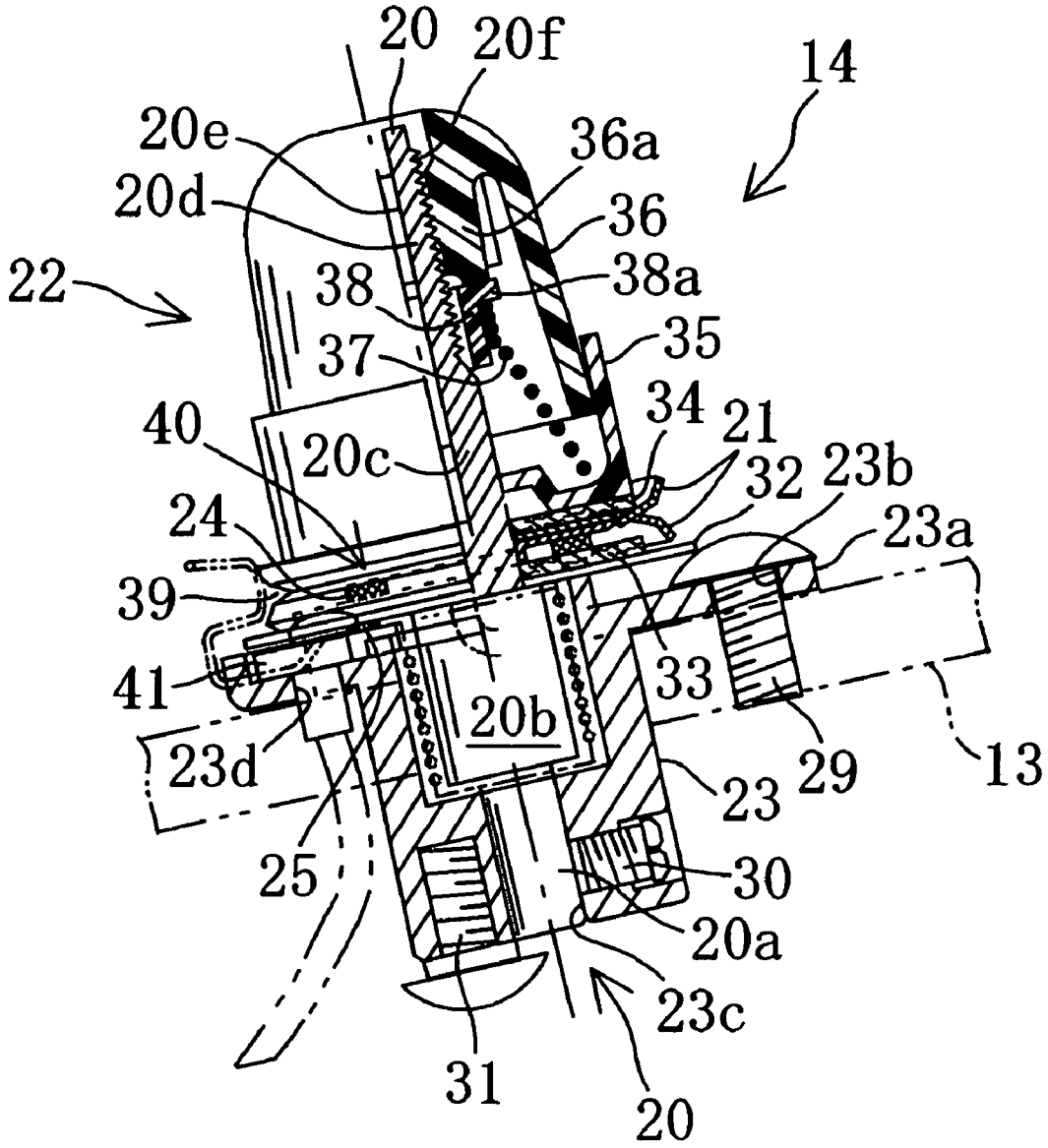
FIG. 2 is a vertical cross-sectional side view of a main portion of a thread tensioner.
Figure 3:
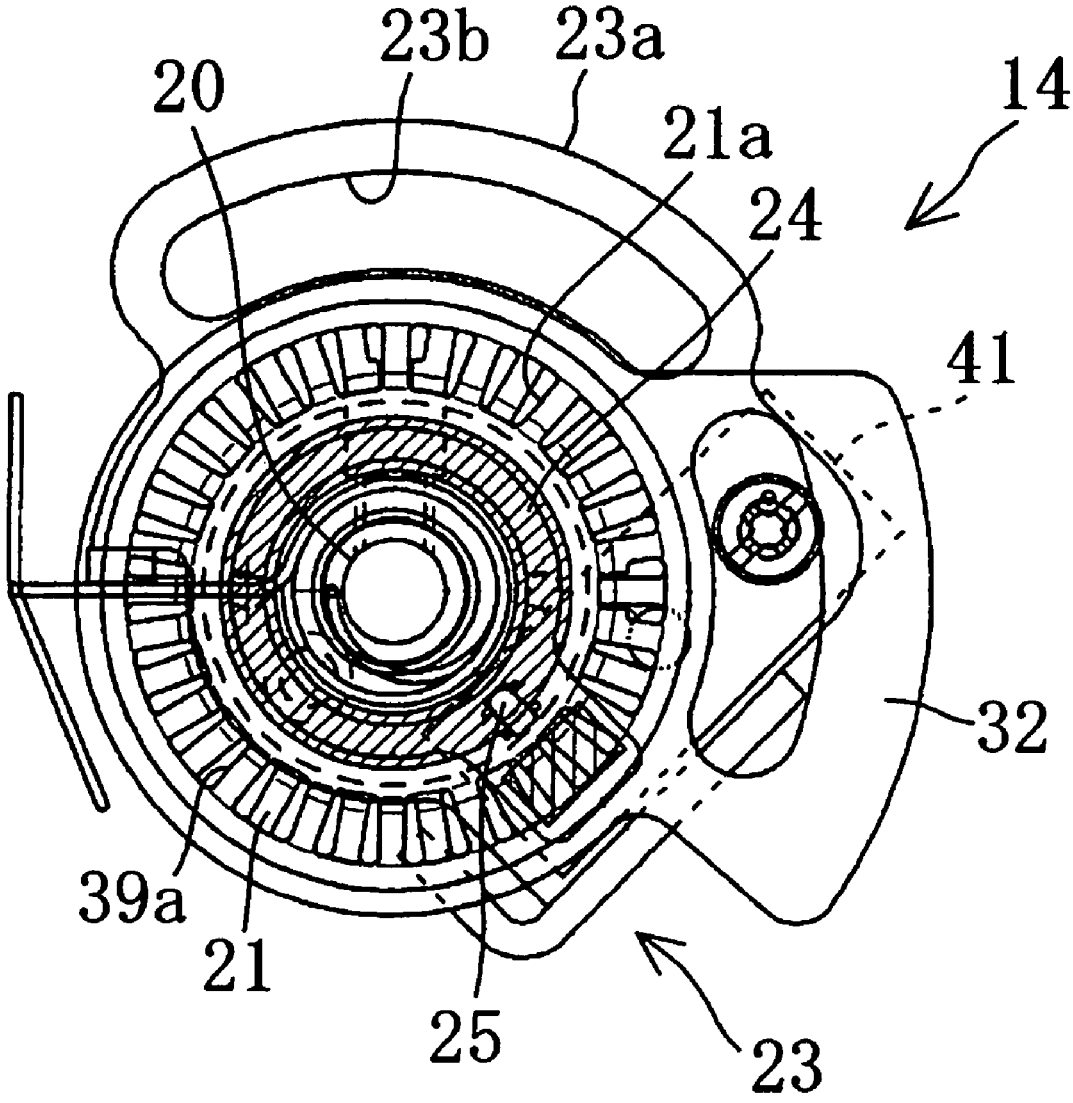
FIG. 3 is a transverse plan view of the main portion of the thread tensioner.

Referring to FIGS. 2 and 3, the thread tensioner 14 includes a shaft 20, rotary discs 21, an adjustment mechanism 22, a flanged body 23, a permanent magnet 24, and a Hall element 25.

The shaft 20 assumes a stepped structure constituted by a small-diameter portion 20*a*, a small-diameter portion 20*b*, a mid-diameter portion 20*c* and a small-diameter portion 20*d*. The small-diameter portion 20*a* and the small-diameter portion 20*b* are contained in the body 23 made of metal. The body 23 is secured by a screw 29 to the thread tension base 13 via a flange 23*a*

An elongate hole 23*b* in a circumferential shape is defined on the flange 23*a*. The body 23, in other words, the thread tensioner 14 is allowed to adjust its positioning with respect to the thread tension base 13 since the body 23 is screw fastened by the elongate hole 23*b*. The small-diameter portion 20*a* of the shaft 20 is tightly fitted into a fitting hole 23*c* of the body 23 and secured integrally to the body 23 by a fastening screw 30. The body 23 is also provided with a fastening screw 31 for earthing.

A groove 20*e* extending in the shaft direction is defined on the shaft member 20 from the distal end of the mid-diameter portion 20*c* and substantially throughout the entire length of the mid-diameter portion 20*c* and the small-diameter portion 20*d*. Male threads 20*f* are defined on the outer-circumference of the small-diameter portion 20*d* across approximately half the length of the small-diameter portion 20*d* measured from its distal end. A thin plate 32 is fitted on the base end of the mid-diameter portion 20*c*. Further, an annular felt material 33, rotary discs 21 and an annular felt material 34 are fitted on the mid-diameter portion 20*c* so as to be rotatable integrally.

The adjustment mechanism 22 adjusts rotational resistance of the rotary discs 21 and includes a rotary disc presser 35, an adjustment dial 36, a compression coil spring 37, and an annular spring guide 38. The rotary disc presser 35 made of synthetic resin material is formed in a cylindrical form with an opened end and is fitted on the mid-diameter portion 20*c* so as to be movable in the shaft direction. The lower end of the rotary disc presser 35 presses the rotary discs 21 with a relatively small force via the felt materials 33 and 34 for applying rotational resistance to the rotary discs 21.

The adjustment dial 36 made of synthetic resin is formed in a substantially tapered cylindrical form having an opened lower end and the lower end is fitted into the rotary disc presser 35. A cylindrical portion 36*a* is formed integrally to the upper half interior of the adjustment dial 36. Female threads are defined on the inner circumference of the cylindrical portion 36*a* to enable fitting on the male threads 20*f* on the small-diameter portion 20*d* of the shaft 20 by thread engagement.

The annular spring guide 38 is fitted on the small-diameter portion 20*d* inside the adjustment dial 36 so as to be movable in the shaft direction. The compression coil spring 37 is provided between the flange 38*a* formed on the upper end of the spring guide 38 and the rotary disc presser 35. The elastic force of the compression coil spring 37 brings the flange 38*a* of the spring guide 38 in abutment with the cylindrical portion 36*a* inside the adjustment dial 36 while the rotary disc presser 35 presses the rotary discs 21. Thus, the spring guide 38 is moved in the shaft direction by manually rotating the adjustment dial 36 to adjust the elastic force of the compression coil spring 37, thereby adjusting the rotational resistance of the rotary discs 21 by adjustment of pressure exerted on the rotary disc presser 35.

The rotary discs 21 are composed of a pair of thin metal discs in back to back engagement with each other. The needle thread is wound once (single winding) around a thread guide groove 39 having a substantially V-shaped cross section which is defined on the outer circumference of the rotary discs 21. A plurality of escape holes 21*a* are defined at predetermined intervals in the circumferential direction in the proximity of the bottom of the thread guide groove 39 of the rotary discs 21. The escape holes 21*a* prevent slippage between the needle thread wound on the thread guide groove 39 and the rotary discs 21.

Next, a description will be given on a rotational amount detection unit 40.

The rotational amount detection unit 40 includes the permanent magnet 24 and the Hall element 25. The annular permanent magnet 24 having a diameter of approximately ½ of the rotary discs 21 and a thickness of approximately 2 to 3 mm is mounted on a side surface perpendicular to the shaft center of the rotary discs 21. The permanent magnet 24 is made of sintered metal and is composed of permanent magnet having a plurality of N-poles and S-poles situated alternately to define an annular disposition as a whole.

The magnetic field of the permanent magnet 24 is oriented in the direction of its thickness (shaft direction of the thread tensioner 14). The Hall element 25 is provided on the substrate secured on the flange 23*a* of the body 23. Thus, when the rotary discs 21 are rotated, the direction of magnetic field projected to the Hall element 25 from the permanent magnet 24 having alternate arrangement of N- and S-poles are switched at small time intervals, thereby causing the Hall element 25 to generate sinusoidal signals. A wave-shaping circuit shapes the waves of the sinusoidal detection signal and thereafter coverts the signals into a rectangular wave-pulse ranging from "0" to "1".

When sewing is started, the rotary discs 21 are rotated by the needle thread moving toward the sewing needle 11. At this time, change in magnetic field directed from the permanent magnet 24 to the Hall element 25 causes sinusoidal detection signal to be outputted from the Hall element 25. The pulse count of the rectangular pulse having its basis on the detection signal enables detection of consumed needle thread amount.

Next, a description will be given on a control system of the multi-needle sewing machine M.

Referring to FIG. 4, a control unit 45 is composed of a microcomputer including a CPU 46, a ROM 47 and a RAM 48. Of note is that the control unit 45 is provided with the wave-shaping circuit that performs wave-shaping of sinusoidal detection signal outputted from the Hall elements 25 and a converter provided to convert the shaped detection signals into pulse signals in rectangular wave form.

The control unit 45 has further connected thereto the operation panel 6, six Hall elements 25 (only one hole element 25 is shown) provided in each thread tensioner 14, a rotational phase angle detection sensor 50 that detects rotational phase angle of the main shaft, a drive circuit 53 for driving the sewing machine motor 18, a drive circuit 54 for driving the needle-bar change motor 17, a drive circuit 55 for driving the X-shaft drive motor 51, and a drive circuit 56 for driving the Y-shaft drive motor 52.

The ROM 47 stores the sewing machine motor control program constituting the feature of the present disclosure that controls the multi-needle sewing machine M to execute a sewing process; and plurality types of pattern data, and the like, for executing embroidery sewing. The RAM 48 allocates memory for storing pattern data for sewing embroidery patterns, stitch-pitch memory for storing the set stitch-pitch, a pulse counter for storing a count of a pulse count signal received from the Hall element 25, and other various buffers, counters and memory, and the like, for temporary storage of the result of calculations performed by the CPU 46.

Next a description will be given on a free motion sewing control executed by the control unit 45 of the multi-needle sewing machine M based on the flowchart indicated in FIG. 5. The reference symbol Si (i=11, 12, 13 . . . ) indicate each step.

When power is supplied to the multi-needle sewing machine M, a pattern group selection screen that displays multiple pattern groups is displayed to the liquid crystal display 6*a* of the operation panel 6. When a normal embroidery pattern is selected in the pattern group selection screen, an embroidery pattern sewing control not shown is started. On the other hand, when free motion is selected, a free motion mode is set and a free motion sewing control is started.

When the free motion mode is set, the X-shaft drive motor 51 and the Y-shaft drive motor 52 are driven by a predetermined amount and the carriage 7 is moved towards the far side, in other words, the rearward direction to stand-by. Thus, the user is allowed to execute quilting on the work table. First, a stitch-pitch setting screen is displayed to the liquid crystal display 6*a* of the operation panel 6 and the user is to set the desired stitch-pitch of "5 mm", for example.

When the stitch-pitch is set by the user, the control unit 45 executes the stitch-pitch setting process that sets the stitch-pitch set by the user as the standard stitch-pitch (S11). At this time, the control unit 45 stores the set stitch-pitch as the standard stitch-pitch to the stitch-pitch memory allocated in the RAM 48.

Figure 6:
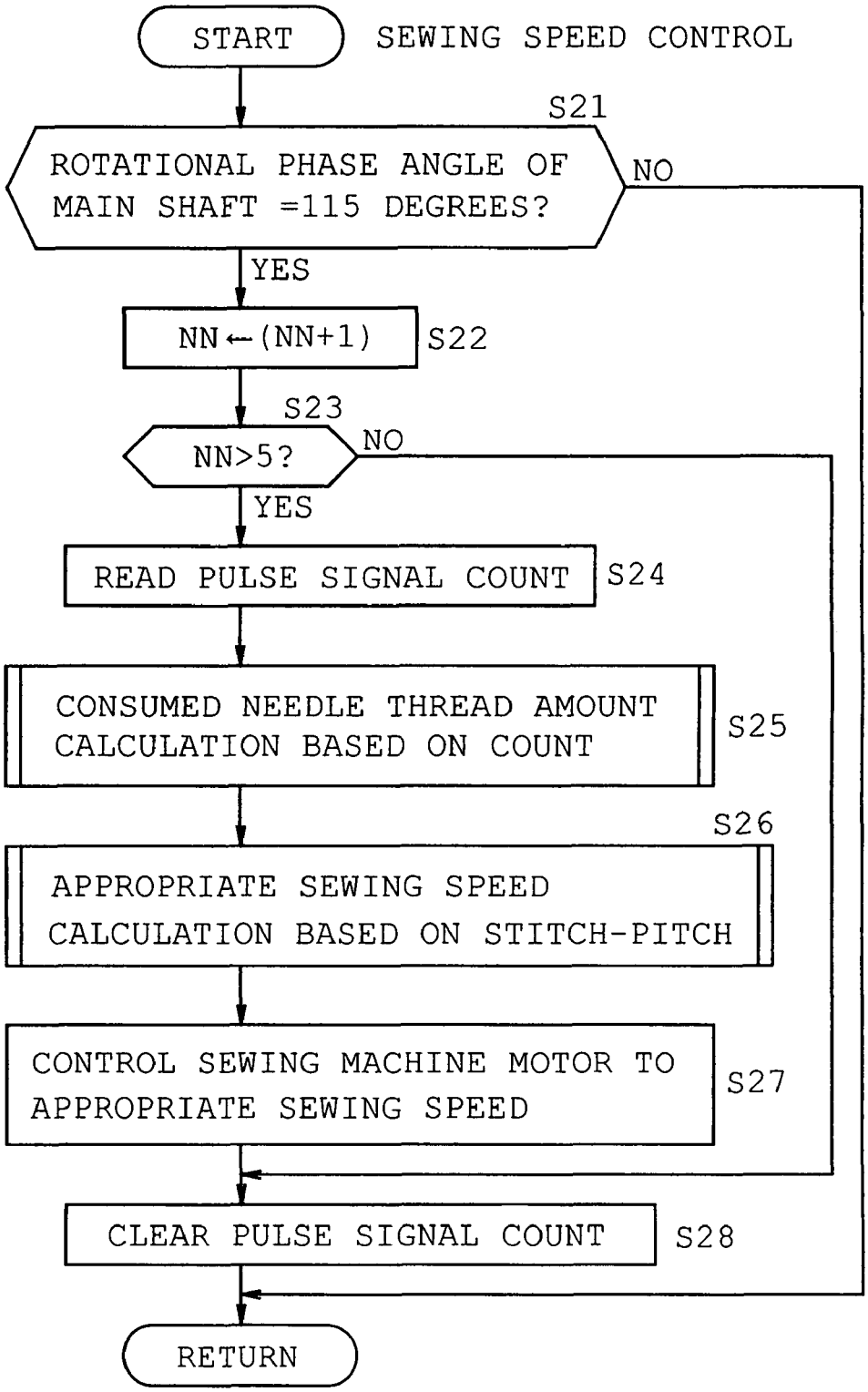
FIG. 6 is a flowchart of a sewing speed control.

Next, when the start/stop switch 6*c* is operated by the user, the control unit 45 starts the sewing machine motor 18 (S12: Yes), and drives the sewing machine motor 18 in a predetermined low-speed rotation (100 rotations/minute, for example) (S13). Then, the control unit 45 initializes the stitch count NN of the stitch counter to "0" (S14) and executes sewing speed control process (refer to FIG. 6) (S15).

When the control unit 45 starts the sewing speed control process, first, the rotational phase angle of the main shaft is obtained based on the phase angle signal inputted from the rotational phase angle detection sensor 50. In case the rotational phase angle is not "115 degrees", in other words, in case the sewing needle 11 is not in the phase angle to strike the quilting fabric (S21: No), the control is terminated immediately. On the other hand, when the sewing needle 11 strikes the quilting fabric and the rotational phase angle reaches "115 degrees" (S21: Yes), the stitch count NN is incremented by one (S22).

Next, in case the stitch count NN is not greater than "5", in other words, the stitch count after sewing has been started is equal to or less than "five stitches" (S23: No), the count of the pulse signal stored in the pulse count memory of the RAM 48 is cleared (S28) and the control is terminated. On the other hand, in case the stitch count NN is greater than "5", that is, when the stitch count reaches the "sixth stitch" after sewing has been started, (S23: Yes), the count of the pulse signal stored in the pulse count memory is read (S24) since the stitches are formed under stable condition.

Next, the control unit 45 calculates consumed needle thread amount based on the count of the pulse signal read (S25). That is, the control unit 45 multiplies the consumed needle thread amount corresponding to a single pulse signal with the count of the pulse signal to calculate the consumed needle thread amount of the current cloth feed as the stitch-pitch. Next, based on the stitch-pitch thus calculated, the control unit 45 calculates the appropriate sewing speed of the sewing machine motor 18 required to obtain the standard stitch-pitch set at S11 (S26).

The control unit 45 calculates the appropriate sewing speed as follows. The actual consumed needle thread amount (actual stitch-pitch) obtained at S25 is multiplied by the current sewing speed of the sewing machine motor 18 and thereafter divided by the standard stitch-pitch set at S11 to obtain the appropriate sewing speed. The control unit 45 controls the sewing machine motor 18 to obtain the appropriate sewing speed (S27). Thus, the control unit 45 controls the sewing speed in accordance with the manual cloth feed amount and provide consistent stitch-pitch. Lastly, the control unit 45 clears the count of the pulse signal (S28); terminates the control and returns to S16 of the free motion sewing control.

In the free motion sewing control, the control unit 45 executes a consumed needle thread amount calculation process (S16) to count up the count of the pulse signal, and the count of the pulse counter is incremented sequentially by the pulse signal inputted from the Hall element 25. Next, in case the start/stop switch 6*c* is not operated (S17: No), the control unit 45 repeats S15 to S17. On the other hand, in case the start/stop switch 6*c* is operated (S17: yes) upon completion of free motion sewing, the control unit 45 terminates the process.

Next, a description will be given on the operation of the multi-needle sewing machine M.

When quilting, first, the user is to set a desired stitch-pitch, "5 mm", for example, by the operation panel 6. Then, when start/stop switch 6*c* is operated to start quilting, sewing is executed at a low-speed of 100 rotations per minute, for example, for the first five stitches of the sewing process until sewing speed is stabilized. The user is to execute quilting by moving the quilting fabric in the given direction for these five stitches as well.

After completing five stitches of low-speed sewing process, from the sixth stitch onwards, at which point the sewing needle 11 strikes the quilting fabric and the rotational phase angle of the main shaft reaches 115 degrees, consumed needle thread amount of the current cloth feed is calculated based on pulse signal count. In case the consumed needle thread amount is "6 mm", the appropriate sewing speed of "120 rotations per minute" can be obtained from the calculation formula described in S26; hence, the sewing machine motor 18 is controlled at the rotational speed of 120 rotations.

Thus, since rotational speed of the sewing machine motor 18 is accelerated, the amount of movement of the quilting fabric per stitch is reduced, and cloth feed amount, that is, the actual stitch-pitch approximates the standard stitch-pitch of "5 mm". Thus, since consistent amount of quilting cloth is manually fed by the user, in other words, since consistent stitch-pitch can be obtained, fine looking quilts can be sewn.

As described above, the present embodiment provides a sewing machine motor 18 that vertically moves the sewing needle via the rotation of the main shaft; and a control unit 45 that sets the stitch-pitch in sewing a manually fed cloth and that detects and calculates consumed needle thread amount of each sewing cycle in an ongoing sewing operation, which calculation result forms the basis for controlling the rotational speed of the sewing machine motor 18 so that the manual cloth feed amount equals the set stitch-pitch. Thus, in case the actual stitch-pitch is greater than the set stitch-pitch, the rotational speed of the sewing machine motor 18 can be accelerated, whereas in case the actual stitch-pitch is less than the specified stitch-pitch, the rotational speed of the sewing machine motor 18 can be decelerated. Thus, the movement distance of the workpiece cloth manually fed by the user, that is, the stitch-pitch can be made consistent with the standard stitch-pitch set in advance without being affected by the color and material of the workpiece cloth and color and brightness of exterior light radiated during the sewing process, thereby allowing sewing of fine-looking quilts.

Also, the sewing speed control is executed in each sewing cycle from the sixth stitch onwards after sewing has been started. Thus, the sewing speed control can be executed under stabilized sewing condition from the sixth stitch onwards and avoid execution of the sewing speed control under unstable condition for forming stitches, which unstable condition lasts up to the fifth stitch after sewing start.

Also, rotary discs 21 arranged to be rotatable by the drawing of the needle thread 19 towards the sewing needle 11 and that apply tension on the needle thread 19; and a rotational amount detection unit 40 that detects rotational amount of the rotary discs 21 have been employed to detect consumed thread amount. Thus, consumed thread amount of needle thread 19 can be detected accurately in a compact and low-cost configuration.

Furthermore, consumed thread amount in each sewing cycle has been arranged to be determined after rotational phase angle of the main shaft has reached the predetermined rotational phase angle (115 degrees) at which rotational phase angle the sewing needle 11 strikes the quilting fabric. Thus, consumed thread amount by cloth feed can be determined after completion of manual cloth feed, thereby allowing the rotational speed of the main shaft to be quickly reflected on the next cloth feed and provide consistent stitch-pitch.

Next, partial modifications of the above described embodiment will be described hereinafter. First, a description will be given on the first modified embodiment.

Figure 7:
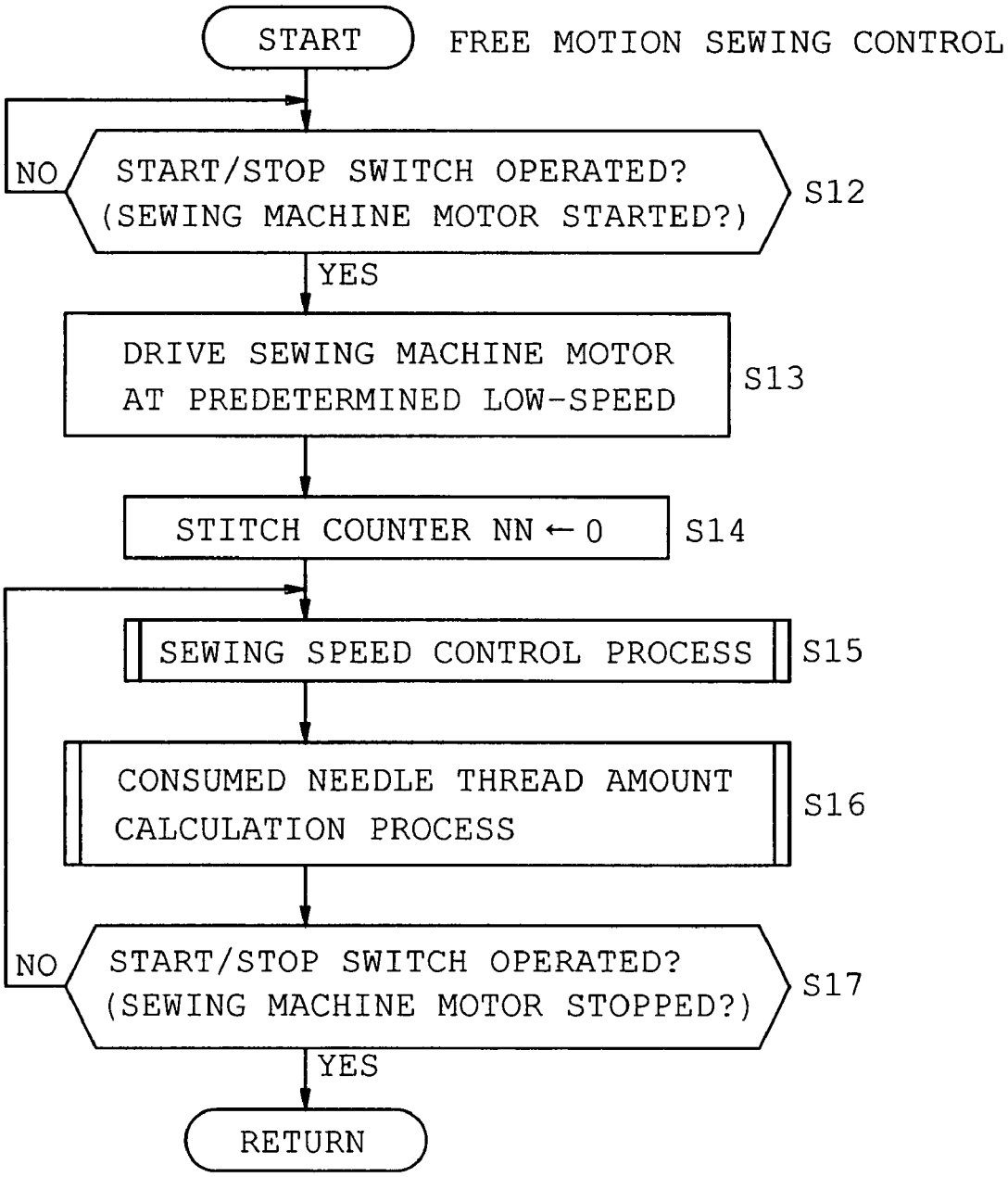
FIG. 7 illustrates a modified embodiment corresponding to FIG. 5.

In the free motion sewing control, instead of allowing the user to set the standard stitch-pitch, the control unit 45 may be arranged to automatically set the standard stitch-pitch with the consumed needle thread amount of the cloth feed of the fifth stitch formed immediately after sewing start. That is, as illustrated in FIG. 7, the control unit 45 starts quilting immediately upon operation of the start/stop switch 6*c* (S12: Yes) by the user without execution of the stitch-pitch setting process that sets the stitch-pitch set by the user as the standard stitch-pitch. S13 to S17 will not be described since they are the same as the free motion control described in the above embodiment.

Figure 8:
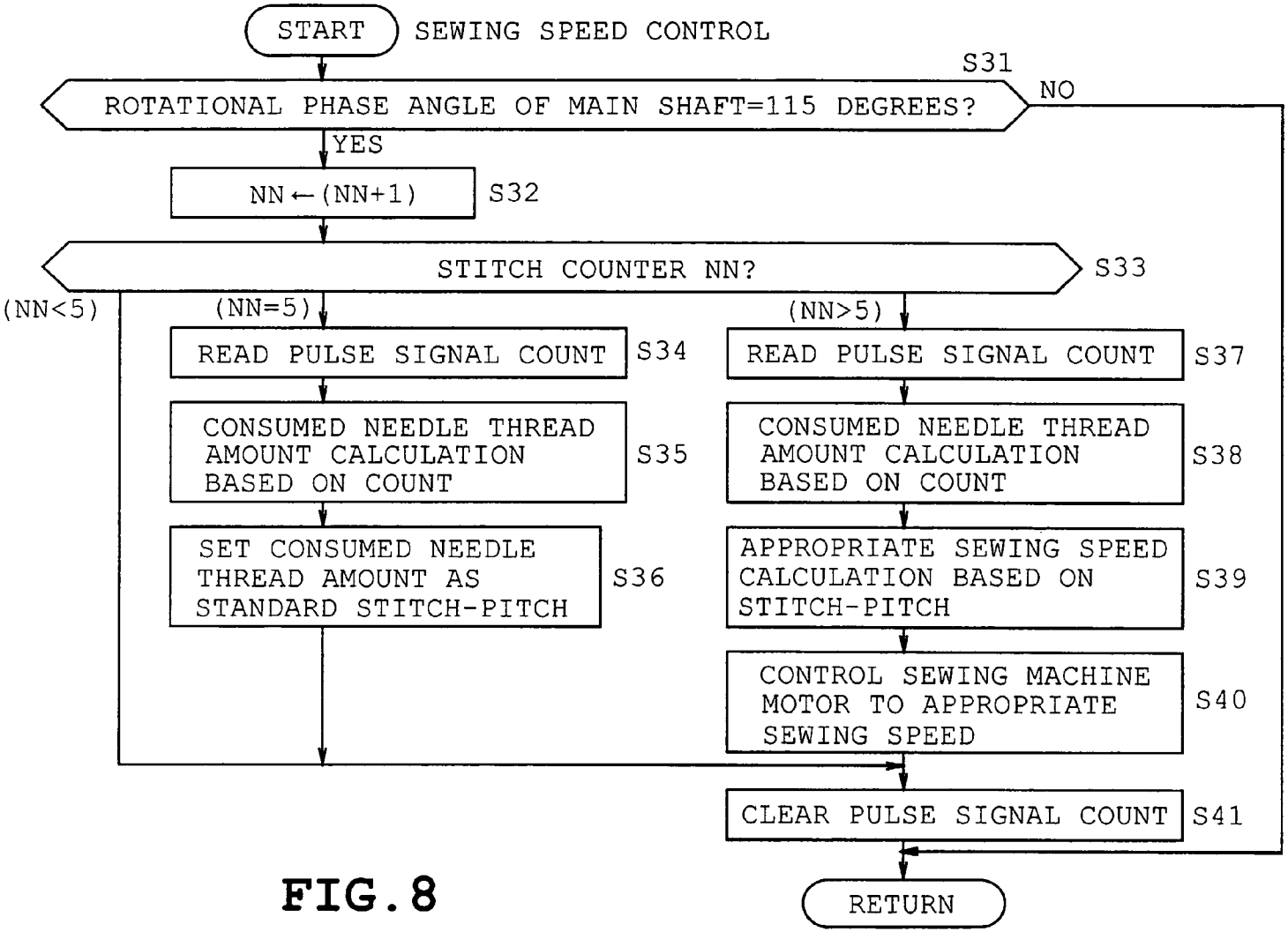
FIG. 8 illustrates a modified embodiment corresponding to FIG. 6.

Next, a partially modified sewing speed control will be described based on FIG. 8. When the rotational phase angle of the main shaft reaches "115 degrees" (S31: Yes), the control unit 45 increments the stitch count NN by one (S32) and in case the stitch count NN is less than "5" (S33), the value of the rotational pulse count is cleared (S41) and the control is terminated immediately. On the other hand, when the stitch count NN reaches "5" (S33), the control unit 45 reads the pulse signal count (S34) and consumed needle thread amount is calculated based on the pulse signal count (S35). Based on the consumed needle thread amount, the standard stitch-pitch is stored and set to the stitch-pitch memory (S36). Thereafter, in case the stitch count NN is greater than "5" (S33), S37 to S41 are executed in the same way as S24 to S28.

Not only does the first modified embodiment achieve the same effects of the aforementioned embodiment, but it also eliminates setting of standard stitch-pitch by the user, thereby improving sewing work efficiency.

Next, a description will be given on a second modified embodiment.

Figure 9:
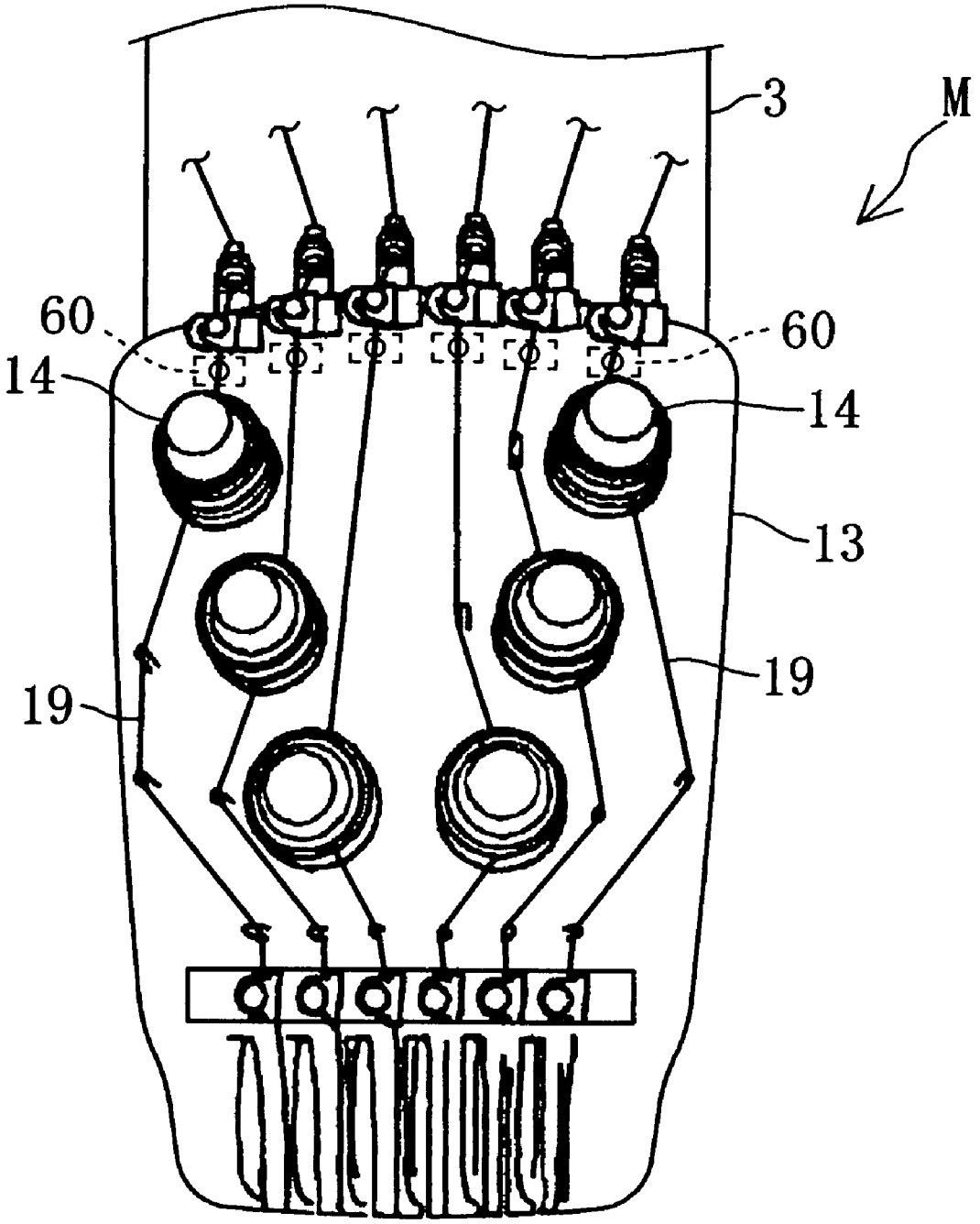
FIG. 9 is a plan view of a of a thread tension base of a multi-needle sewing machine.

The consumed needle thread amount may be detected by a CMOS image sensor 60*a* provided in the thread path of the arm. That is, as illustrated in FIG. 9, sensor units 60 are provided in the interior of the rear end proximity of the thread tension base 13 of the multi-needle sewing machine M so as to correspond to each of the six needle thread paths.

Figure 10:
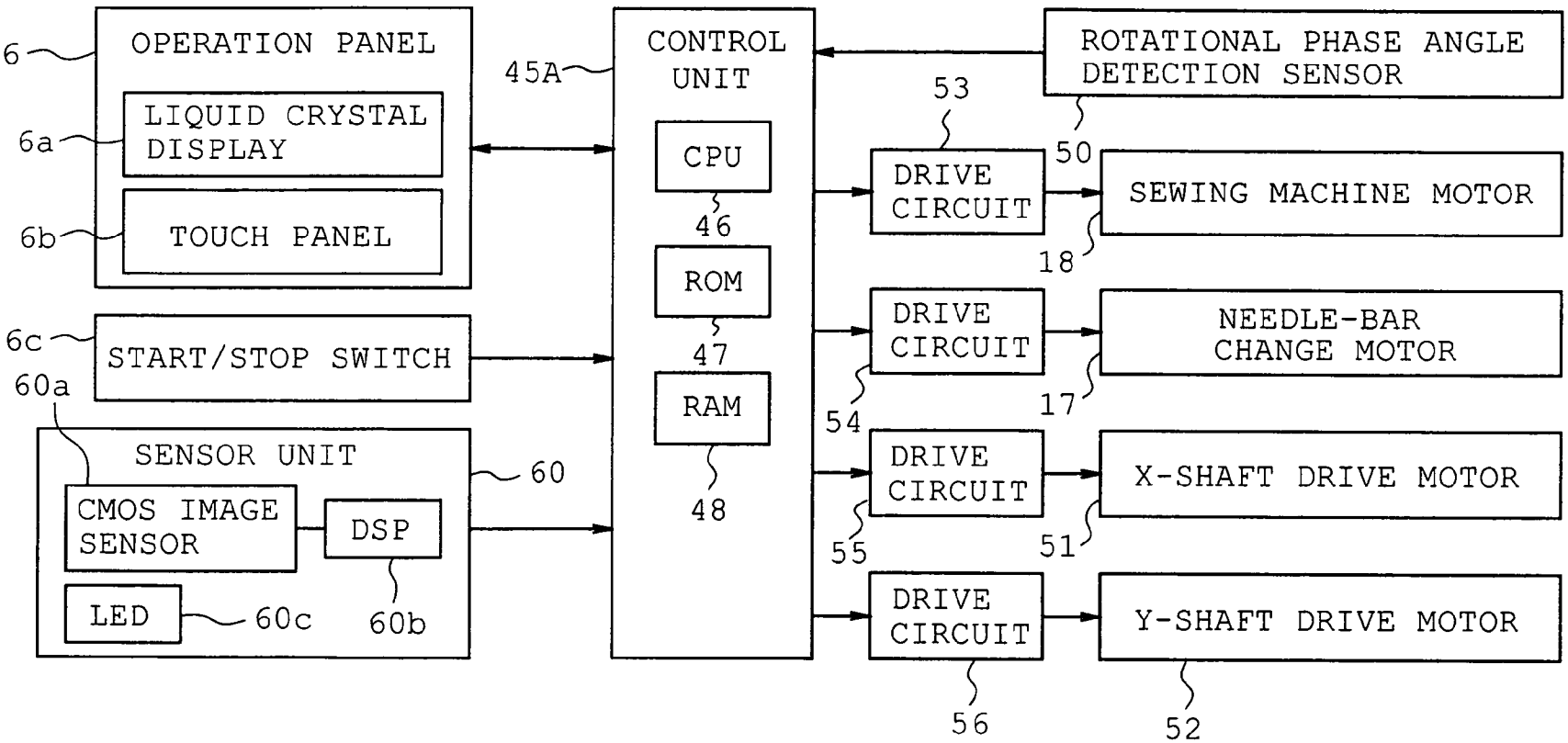
FIG. 10 illustrates a modified embodiment corresponding to FIG. 4.

Referring to FIG. 10, each sensor unit 60 includes a CMOS image sensor 60*a*, a DSP (digital signal processor) 60*b* connected to the CMOS image sensor 60*a*, and an LED (light emitting diode) 60*c*. The CMOS image sensor 60*a* is capable of capturing the image of the needle thread 19 via an opening defined in the thread tension base 13.

The DSP 60*b* of the sensor unit 60 is composed of a single microcomputer chip and multiple image data (image information) captured at small time intervals by the CMOS image sensor 60*a* undergo sequential signal processing to calculate and store the total movement amount of needle thread from the start of image capturing, and the calculated total movement amount can be outputted to a control unit 45A.

Referring to FIG. 10, the control unit 45A bears substantially the same configuration as the control unit 45 of the aforementioned embodiment. However, the control unit 45A has six sensor units 60 (only one of the sensor units 60 is shown) connected thereto.

Figure 11:
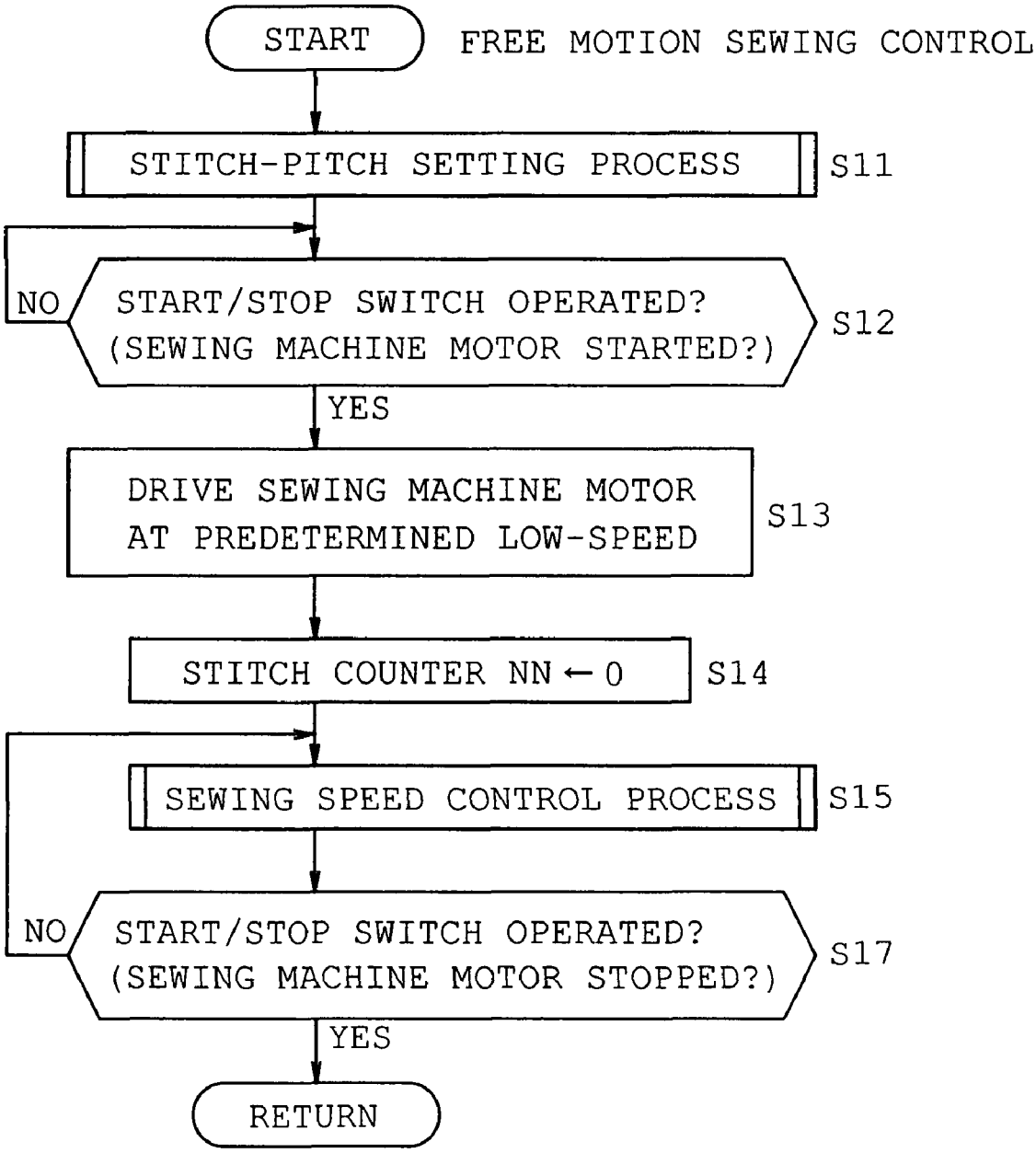
FIG. 11 illustrates a modified embodiment corresponding to FIG. 5.

Next, a description will be given on a free motion sewing control that controls rotational speed of the sewing machine motor 18 that detects consumed needle thread amount based on the image information supplied by the sensor unit 60. As can be seen in FIG. 11, the free motion sewing control merely has S16 eliminated from the free motion sewing control of the aforementioned embodiment. Thus, no detailed description will be given therefor.

Figure 12:
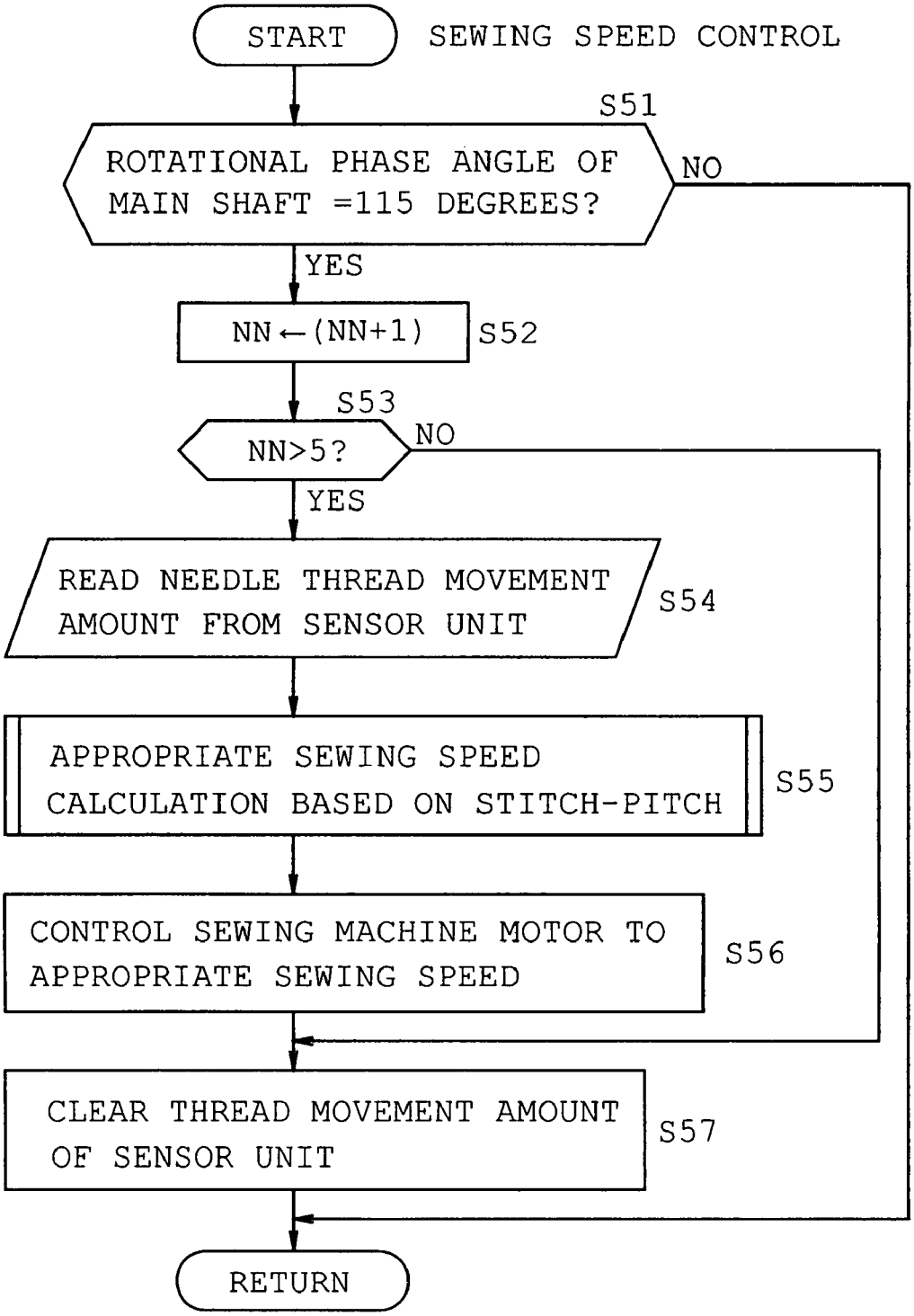
FIG. 12 illustrates a modified embodiment corresponding to FIG. 6.

Next, a description will be given on a sewing speed control illustrated in FIG. 12. S51 to S53 of the sewing speed control are the same as S21 to S23 of the aforementioned embodiment. In case the stitch count NN is greater than "5" (S53: Yes), the control unit 45A reads needle thread movement amount from the sensor unit 60 (S54). The needle thread movement amount read indicates the needle thread movement amount in a single sewing cycle for every instance of the main shaft reaching the rotational phase angle of 115 degrees.

Next, the control unit 45A executes S55 to S56 in the same way as the aforementioned S26 to S27 and controls the sewing machine motor 18 to the appropriate sewing speed. Thereafter, the control unit 45A sends a clear command to the sensor unit 60 to clear the thread movement amount of the sensor unit 60 (S57).

The second modified embodiment employs CMOS image sensor 60*a* that captures images of needle thread at small time intervals and a sensor unit 60 that calculates consumed thread amount by processing multiple image data outputted from the CMOS image sensor 60*a* in order to detect the consumed thread amount. Thus, consumed thread amount of the needle thread 19 can be obtained accurately by non-contact image processing in a compact and low-cost configuration. A CCD image sensor may be employed instead of the CMOS image sensor 60*a*.

Next, a description will be given on a third modified embodiment.

The consumed needle thread amount may be detected by the rotational phase angle of the main shaft when a thread take-up spring 71 is switched from a spring-force non-operating position to a spring-force operating position and rotational speed of the sewing machine motor 18 may be controlled based on the rotational phase angle of the main shaft when the switch is made.

Figure 13:
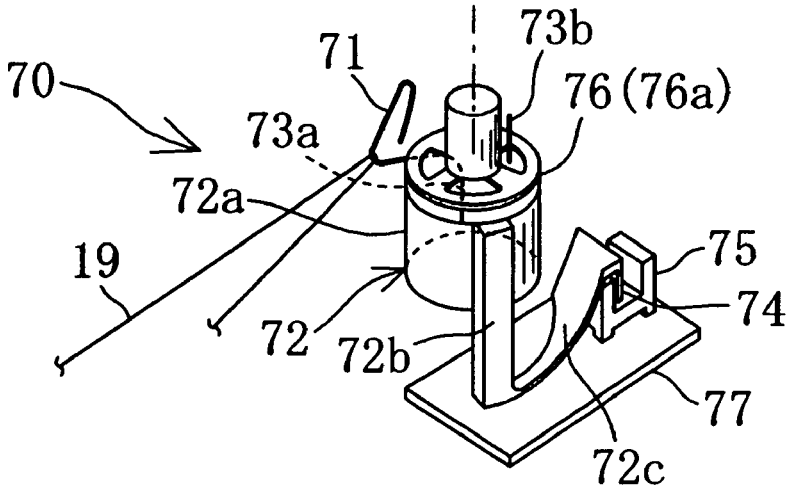
FIG. 13 is a perspective view of a switch detection unit.

A switch detection unit 70 that detects switching of the thread take-up spring 71 to the spring-force operating position, in which spring force is operated on the needle thread 19, will be described with reference to FIGS. 13 and 14. The switch detection unit 70 is provided in the thread tension base 13 in the proximity of the thread tensioner 14. The switch detection unit 70 includes a thread take-up spring 71 threaded with the needle thread 19 extending from the thread tensioner 14 to the thread take-up 12 and swinging substantially in synchronization with the thread take-up 12; a swing element 72 in a cylindrical form that swings integrally with the thread take-up spring 71; a twisted spring 73 that applies rotational bias on the thread take-up spring 71 towards a swinging side;

a shutter 74 provided in the swing element 72; and a switch detection sensor 75 composed of a photo-interrupter capable of detecting the rotational position of the shutter 74.

The thread take-up spring 71 in bent form is formed on the distal end portion of the twisted spring 73, and most part of the twisted spring 73 is contained inside a spring holder 76 made of synthetic resin. The spring holder 76 is secured to the thread tension base 13.

The twisted spring 73 is provided with a lever portion 73*a* bent radially outward and the thread take-up spring 71 is formed by bending the distal end portion of the lever 73*a*. Also, the twisted spring 73 has a connecting linear portion 73*b* extending linearly that is inserted and connected unrotatably to the spring holder 76.

The swing element 72 made of synthetic resin is formed integrally by a cylindrical portion 72*a* fitted rotatably on the spring holder 76; a bar 72*b* extending downward from the outer peripheral side of the cylindrical portion 72*a*; and a swing portion 72*c* extending horizontally from the lower end of the bar 72*b*. A shutter 74 is formed integrally on the distal end of the swing portion 72*c*.

A hook 76*a* is formed integrally on one end of the spring holder 76 and the cylindrical portion 72*a* of the swing element 72 is in abutment with the hook 76*a* to be fitted on the spring holder 76. The swing element 72 is allowed to swing integrally with the thread take-up spring 71. Further, a substrate 77 secured to the thread tension base 13 has the switch detection sensor 75 having a light emitting portion and light receiving portion confronting each other mounted thereon and the shutter 74 is arranged movably between the light emitting portion and the light receiving portion.

Figure 14:
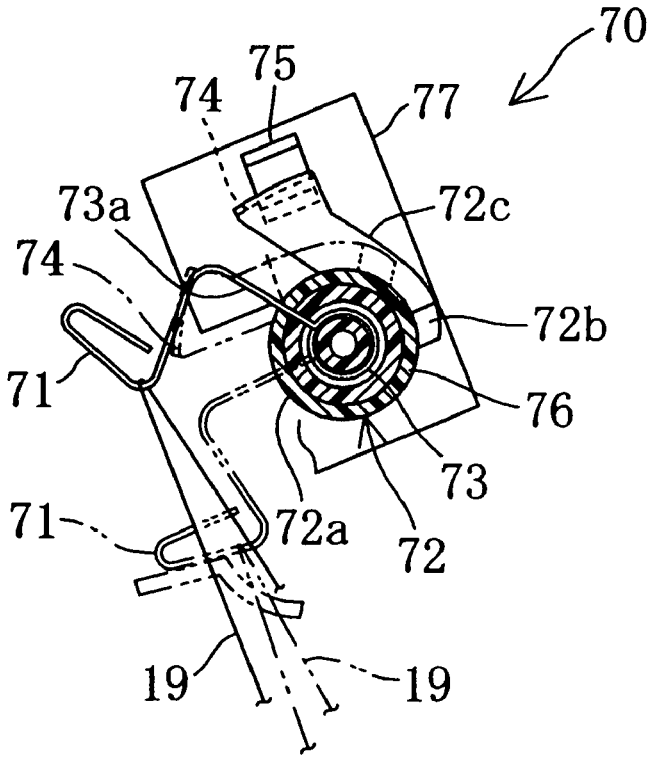
FIG. 14 is a plan view of a switch detection unit.

Thus, when the thread take-up spring 71 is in the spring-force non-operating position indicated by solid line in FIG. 14, the shutter 74 provides blockage between the light emitting portion and the light receiving portion of the switch detection sensor 75 and the shutter 74 is detected by the switch detection sensor 75. On the other hand, when the thread take-up spring 71 is in the spring-force operating position indicated by double-dot chain line in FIG. 14, the shutter 74 is switched so as to be moved away from between the light emitting portion and the light receiving portion of the switch detection sensor 75 and the shutter 74 is not detected by the switch detection sensor 75.

During a sewing operation, when the sewing needle 11 is moved below the workpiece cloth, since the thread take-up 12 is lowered in synchronization with the lowering of the sewing needle 11, the thread take-up spring 71 is switched to the spring-force non-operating position indicated by solid line in FIG. 14. On the other hand, when the workpiece cloth is fed with the sewing needle 11 moved above the workpiece cloth, since the needle thread 19 required due to the consumed needle thread amount consumed by the cloth feed amount is drawn from the thread spool and supplied to the sewing needle 11, the thread take-up spring 71 is swung in resistance of the rotational elasticity of the twisted spring 73 to be switched to the spring-force operating position indicated by double-dot chain line in FIG. 14.

Thus, in case the thread take-up spring 71 is switched to the spring-force non-operating position, an "L" level detection signal is outputted from the switch detection sensor 75 continuously for a predetermined time. On the other hand, when the thread take-up spring 71 is switched to the spring-force operating position, the shutter 74 does not provide blockage between the light emitting portion and the light receiving portion of the switch detection sensor 75, thus, "H" level detection signal is outputted from the switch detection sensor 75 continuously for a predetermined time.

Next, a description will be given on a control system of the multi-needle sewing machine M.

Figure 15:
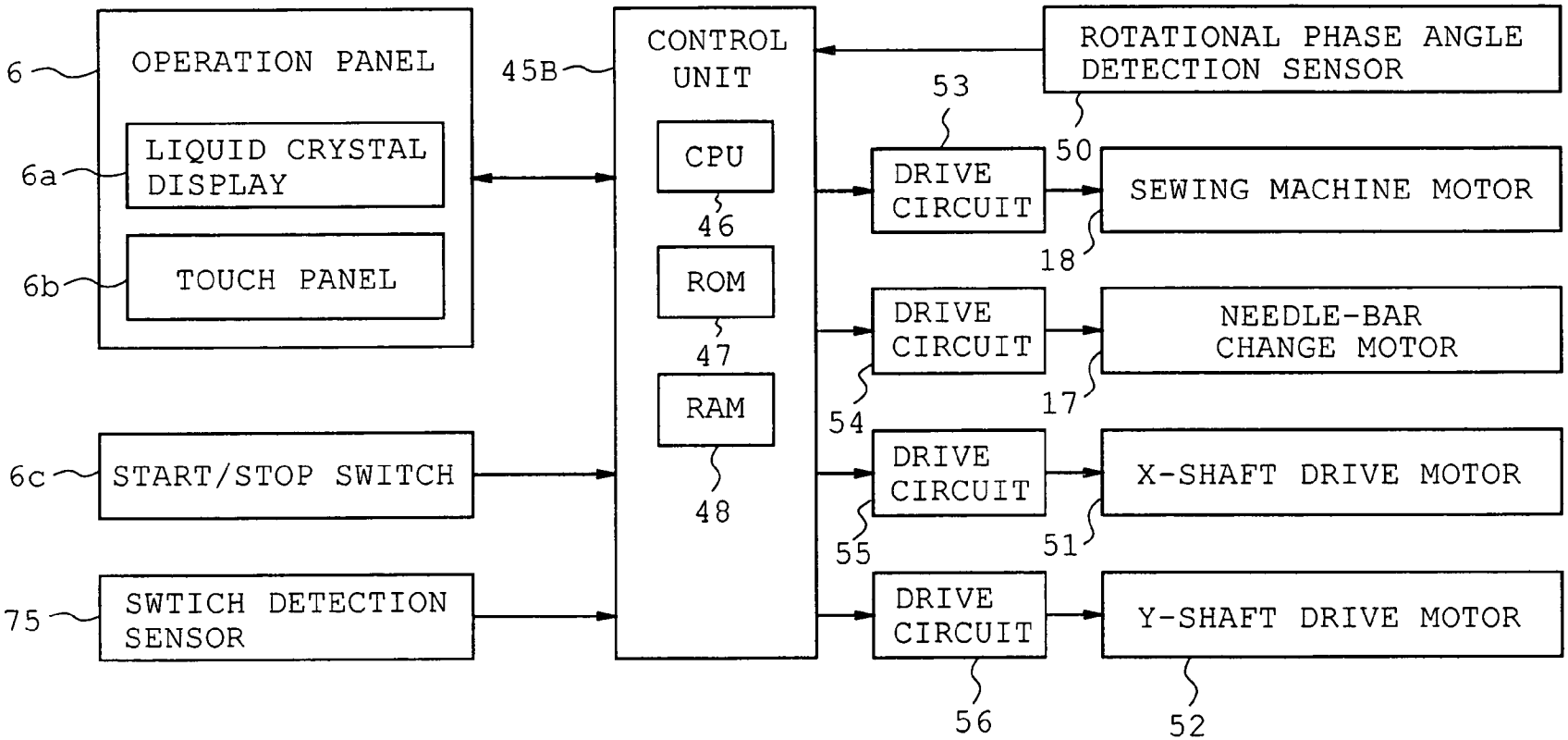
FIG. 15 illustrates a modified embodiment corresponding to FIG. 4.

Referring to FIG. 15, a control unit 45B bears substantially the same configuration as the control unit 45 of the aforementioned embodiment. However, the control unit 45B has six switch detection sensors 75 (only one of the switch detection sensors 75 is shown) electrically connected thereto.

Next, a description will be given on a free motion sewing control executed by the control unit 45B.

Figure 5:
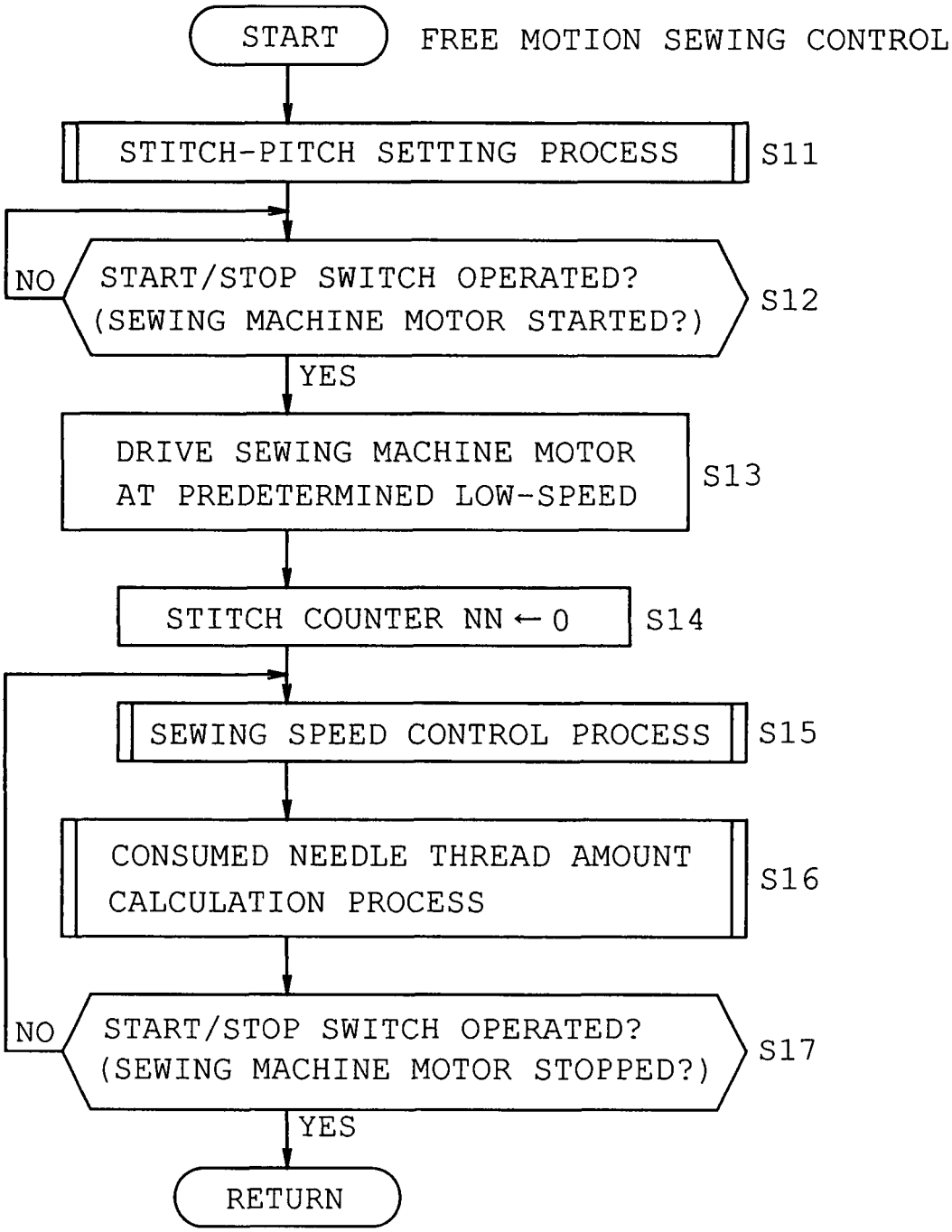
FIG. 5 is a flowchart of a free motion sewing control.
Figure 16:
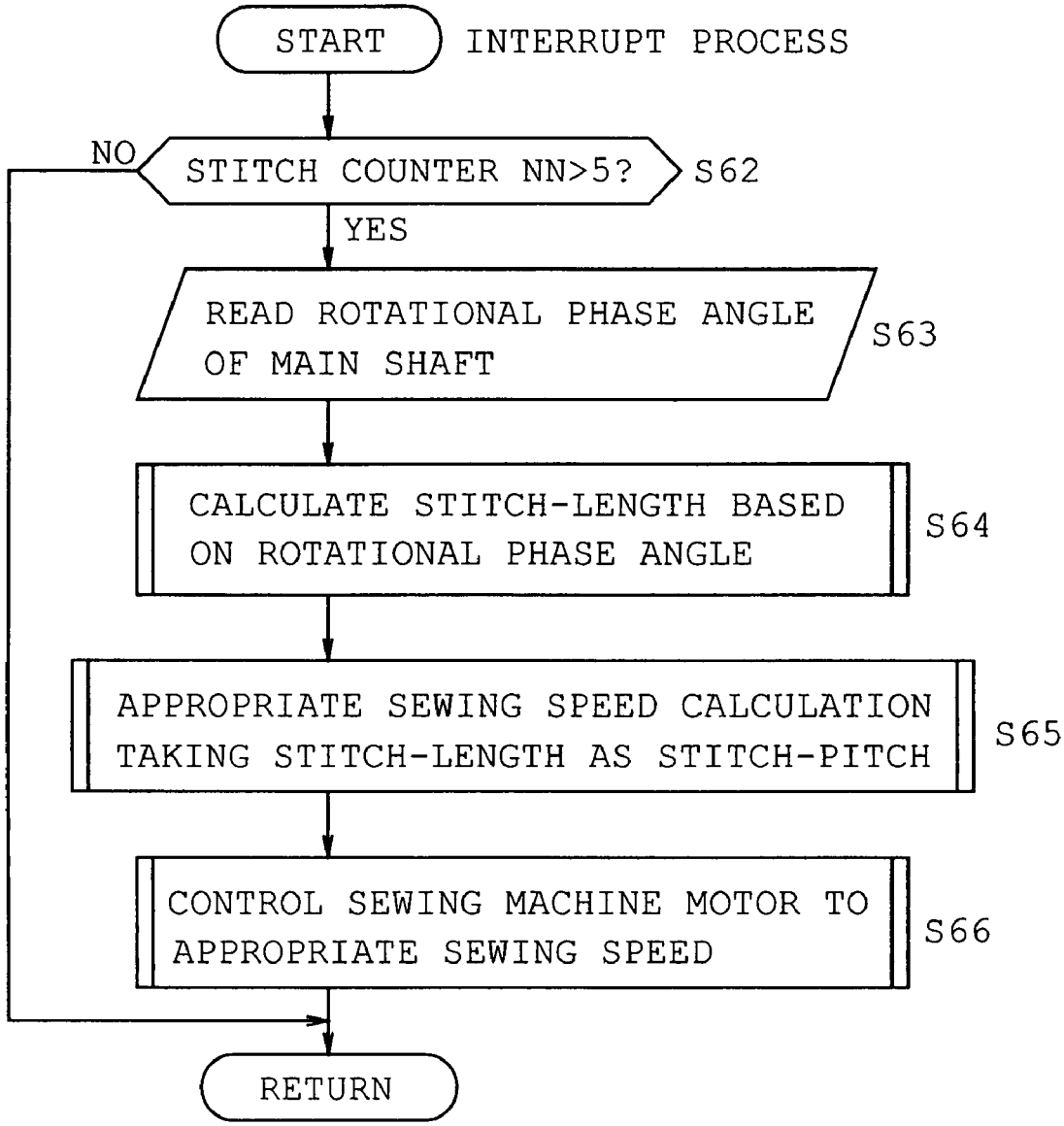
FIG. 16 is a flowchart of an interrupt process control.

The control unit 45B controls the sewing machine motor 18 by executing interrupt process indicated in FIG. 16 while executing the free motion sewing control indicated in FIG. 5 described in the aforementioned embodiment.

When the rotational phase angle of the main shaft reaches approximately 70 degrees, the needle thread 19 consumed by cloth feed is drawn from the thread spool by tightening of the thread caused by vertical movement of the thread take-up 12, whereby the thread take-up spring 71 is switched to the spring-force operating position within the rotational phase angle of the main shaft ranging from approximately 350 to 20 degrees. The control unit 45B executes interrupt process indicated in FIG. 16 every time "H" level detection signal is inputted from the switch detection sensor 75.

When the interrupt process is executed, the control unit 45B immediately terminates the control in case the stitch count NN is "equal to or less than 5" (S62: No). On the other hand, in case the stitch count NN is "greater than 5" (S62: Yes), the rotational phase angle of the main shaft at such timing is read (S63) and the stitch-length is calculated based on the phase angle θ (S64). In the stitch-length calculation process, the control unit 45B performs calculation based on $-0.001\theta^3+0.0407\theta^2\times2.0455\theta+27.2$. Of note is that, the angle θ is given in continuous numerical value in which, for example, 350 degrees is described as −10 degrees.

Next, the control unit 45B takes the stitch-length as the stitch-pitch and calculates the appropriate sewing speed (S65) The calculation of appropriate sewing speed is carried out in the same way as S26 of the aforementioned embodiment; thus, the description for the same will not be given. The control unit 45B controls the sewing machine motor 18 to the appropriate sewing speed thus obtained (S66) and terminates the control.

A phase angle table data associating the consumed needle thread amount with the rotational phase angle of the main shaft may be stored in the ROM 47 in advance; and in S64, the control unit 45B may obtain the consumed needle thread amount corresponding to the read phase angle by referring to the phase angle table.

In the third modified embodiment, the switch timing in which the thread take-up spring 71 is switched from the spring-force non-operating position to the spring-force operating position is detected by the rotational phase angle of the main shaft, whereby the timing in which the supply of needle thread due to consumption of needle thread 19 by cloth feed is to be started is detected so as to allow the detection of consumed thread amount. Based upon the consumed thread amount thus detected, rotational speed of the sewing machine motor can be controlled since the timing in which thread supply for supplying needle thread consumed by cloth feed is started is accelerated when consumed thread amount is large and decelerated when consumed thread amount is small.

Also, in supplying needle thread 19 consumed by cloth feed from the thread spool, the greater the consumed thread amount, the earlier the timing of the thread take-up spring 71 switching to the spring-force operating position at the terminal point of cloth feed. Thus, the control of the sewing machine motor 18 corresponding to the consumed thread amount of the current cloth feed can be reflected immediately at the terminal point of the current cloth feed. Moreover, when the rotational phase angle of the main shaft reaches 115 degrees, since the speed control of the sewing machine motor 18 is executed successively by the sewing speed control described in the aforementioned embodiment, control accuracy of the rotational speed of the sewing machine motor 18 can be improved considerably.

The timing to start needle thread supply from the thread spool for the needle thread consumed by cloth feed may be detected by the timing in which rotation of the rotary discs 21 of the rotational amount detection unit 40 is started or may be detected by a CMOS image sensor. The speed of the sewing machine motor 18 may be controlled based on such timings.

Next, a description will be given on a fourth modified embodiment.

In the aforementioned embodiment, consumed thread amount in the sewing operation has been obtained for the needle thread 19; however, consumed thread amount for a bobbin thread may be obtained by similarly calculating bobbin thread movement amount by providing a CMOS image sensor near a rotary shuttle. Based on the consumed bobbin thread amount thus obtained, consistent stitch-pitch may be obtained by controlling the rotational speed of the sewing machine motor 18.

Next, a description will be given on a fifth modified embodiment.

The thread tensioner 14 described in the aforementioned embodiment applies tension on the needle thread by the rotary discs 21 and detects consumed needle thread amount by the amount of rotation of the rotary discs 21. However, a thread tensioner having thread tension discs for applying tension on the needle thread and a consumed thread amount detector having rotary discs for detecting consumed needle thread amount may be provided separately.

Next, a description will be given on a sixth modified embodiment.

The switch detection unit 70 provided with the thread take-up spring 71 may be provided inside the needle bar case 4.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

What is claimed is:

1. An electronic sewing machine, comprising:

a sewing machine motor that vertically drives a sewing needle via a rotation of a main shaft;

a stitch-pitch setting unit that sets a stitch-pitch in sewing manually fed workpiece cloth;

a consumed thread amount detection unit that detects consumed thread amount of at least either of a needle thread or a bobbin thread consumed in each ongoing sewing cycle;

a consumed thread amount calculation unit that calculates consumed thread amount based on an output from the consumed thread amount detection unit; and a speed control unit that controls rotational speed of the sewing machine motor based on calculated result of the consumed thread amount calculation unit so that an amount of manual cloth feed equals the stitch-pitch set by the stitch-pitch setting unit;

wherein the consumed thread amount detection unit determines the consumed thread amount in each of the sewing cycles after a rotational phase angle of the main shaft reaches a predetermined rotational phase angle at which rotational phase angle the sewing needle strikes the workpiece cloth.

2. The sewing machine of claim 1, wherein the consumed thread amount detection unit includes rotary discs arranged to be rotatable by drawing of the needle thread towards the sewing needle and a rotational amount detection unit that detects rotational amount of the rotary discs.

3. The sewing machine of claim 1, wherein the consumed thread amount detection unit includes an imaging unit composed of a CCD image sensor or a CMOS image sensor that captures images of at least either of the needle thread or the bobbin thread and an image data processing unit that processes image data outputted from the imaging unit.

4. The sewing machine of claim 1, wherein the consumed thread amount detection unit includes a rotational phase angle detection unit that detects rotational phase angle of the main shaft, and a timing detection unit that detects a timing to start thread supply of at least either of the needle thread or the bobbin thread associated with consumption of at least either of the needle thread or the bobbin thread.

5. The sewing machine of claim 4, wherein the timing detection unit includes a thread take-up spring provided on a thread path on which the needle thread is threaded and a thread take-up spring timing detection unit that detects a switch timing in which the thread take-up spring is switched from a spring-force non-operating position where the spring force of the thread take-up spring is not operated on the needle thread and a spring-force operating position where the spring force of the thread take-up spring is operated on the needle thread.

6. The sewing machine of claim 1, wherein the speed control unit controls the rotational speed of the sewing machine motor so that the amount of manual cloth feed equals the stitch-pitch set by the stitch-pitch setting unit based on the calculated result of the consumed thread amount calculation unit after a number of stitches formed by the sewing needle in a sewing process has reached a predetermined number of stitches.

7. The sewing machine of claim 1, wherein the stitch-pitch setting unit automatically sets the stitch-pitch based on a consumed needle thread amount consumed by cloth feed for forming a predetermined number of stitches immediately after sewing start.

8. A computer readable medium storing a sewing machine motor control program executed by a computer of a control unit that controls an electronic sewing machine provided with a sewing machine motor that vertically drives a sewing needle via rotation of a main shaft, the program comprising:

instructions for setting a stitch-pitch in sewing manually fed workpiece cloth;

instructions for detecting consumed thread amount of at least either of a needle thread or a bobbin thread consumed in each ongoing sewing cycle;

instructions for calculating consumed thread amount based on an output from the instructions for detecting consumed thread amount; and instructions for controlling rotational speed of the sewing machine motor based on calculated result of the instructions for calculating so that an amount of manual cloth feed equals the stitch-pitch set by the instructions for setting;

wherein the instructions for detecting consumed thread amount determines the consumed thread amount in each of the sewing cycles after a rotational phase angle of the main shaft reaches a predetermined rotational phase angle at which rotational phase angle the sewing needle strikes the workpiece cloth.

9. The program computer readable medium of claim 8, wherein the instructions for detecting consumed thread amount includes instructions for detecting rotational amount of rotary discs that are arranged to be rotatable by drawing of the needle thread towards the sewing needle.

10. The computer readable medium of claim 8, wherein the instructions for detecting consumed thread amount includes instructions for imaging that captures images of at least either of the needle thread or the bobbin thread and instructions for image data processing that processes image data outputted from the instructions for imaging.

11. The computer readable medium of claim 8, wherein the instructions for detecting consumed thread amount includes instructions for detecting rotational phase angle of the main shaft, and instructions for detecting a timing to start thread supply of at least either of the needle thread or the bobbin thread associated with consumption of at least either of the needle thread or the bobbin thread.

12. The computer readable medium of claim 11, wherein the instructions for detecting the timing to start the thread supply includes instructions for detecting thread take-up switch timing in which timing a thread take-up spring provided on a thread path on which the needle thread is threaded is switched from a spring-force non-operating position where the spring force of the thread take-up spring is not operated on the needle thread and a spring-force operating position where the spring force of the thread take-up spring is operated on the needle thread.

13. The computer readable medium of claim 8, wherein the instructions for controlling controls the rotational speed of the sewing machine motor so that the amount of manual cloth feed equals the stitch-pitch set by the instructions for setting based on the calculated result of the instructions for calculating after a number of stitches formed by the sewing needle in a sewing process has reached a predetermined number of stitches.

14. The computer readable medium of claim 8, wherein the instructions for setting automatically sets the stitch-pitch based on a consumed needle thread amount consumed by cloth feed for forming a predetermined number of stitches immediately after sewing start.

* * * * *